US007669743B2

(12) United States Patent
Bruton

(10) Patent No.: US 7,669,743 B2
(45) Date of Patent: Mar. 2, 2010

(54) ADJUSTABLE INFANT CARRIER

(76) Inventor: Cammi A. Bruton, 70 Durning Rd., Van Alstyne, TX (US) 75495

( * ) Notice: Subject to any disclaimer, the term of this patent is extended or adjusted under 35 U.S.C. 154(b) by 909 days.

(21) Appl. No.: 11/434,837

(22) Filed: May 15, 2006

(65) Prior Publication Data

US 2006/0208018 A1 Sep. 21, 2006

Related U.S. Application Data

(63) Continuation-in-part of application No. 10/821,095, filed on Apr. 8, 2004, now abandoned.

(51) Int. Cl.
*A61G 1/00* (2006.01)

(52) U.S. Cl. ..... 224/159; 224/158

(58) Field of Classification Search ..... 224/158–161
See application file for complete search history.

(56) References Cited

U.S. PATENT DOCUMENTS 1,307,597 A * 6/1919 Orloff ..... 224/575
2,496,216 A * 1/1950 Kaminski ..... 224/159
4,986,458 A * 1/1991 Linday ..... 224/160
D425,696 S * 5/2000 Swanke ..... D3/213

* cited by examiner

*Primary Examiner*—Tri M Mai
(74) *Attorney, Agent, or Firm*—Michael Diaz

(57) ABSTRACT

An apparatus for carrying an infant upon the hip of an individual is disclosed. The apparatus includes a harness for supporting the infant. The apparatus also includes a far shoulder strap supported by one shoulder of the individual. The far shoulder strap has a front section resting on the chest region of the individual and a back section resting on a back region of the individual. The apparatus also includes a second near shoulder strap supported by the other shoulder of the individual. Each shoulder strap may include a pad for placement upon the shoulder to provide comfort while supporting the weight of the infant. The infant rests upon the hip of the individual. Both shoulders and one hip of the individual support the weight of the infant.

15 Claims, 3 Drawing Sheets

ADJUSTABLE INFANT CARRIER

RELATED APPLICATIONS

This application is a continuation-in-part of a U.S. patent application Ser. No. 10/821,095 by Cammi A. Bruton entitled "CARRIER FOR SUPPORTING AN INFANT ON A HIP," filed Apr. 8, 2004 now abandoned and is hereby incorporated in its entirety by reference herein.

BACKGROUND OF THE INVENTION

1. Field of the Invention

This invention relates to infant carriers. Specifically, the present invention relates to an apparatus for carrying an infant on a hip of an adult.

2. Description of the Related Art

As is known to most parents, infants need to be carried when traveling. However, after approximately the first six months, carrying an infant can be difficult. The infant becomes quite heavy and tends to move around quite a bit. To assist parents in carrying their young children, infant carriers are used to carry and support an infant. Existing infant carriers are available in a wide variety of configurations. One type of infant carrier is a backpack where the infant is carried upon the back of an adult. This type of carrier suffers from several disadvantages. First, the infant is positioned on the adult's back and therefore it is very difficult for the adult to see the infant. Second, for infants over six months, the backpack type carrier is not comfortable for the infant to be carried. The full weight of the infant rides in a harness, which puts considerable pressure on the infant's waste and crotch region.

Another type of existing carrier is a sling carrier, which typically includes one strap wrapped around a shoulder of the carrying adult. The infant is precariously held in a piece of material in a manner similar to a person lying in a hammock. Some of these sling-configured carriers also enable the infant to rest upon the adult's hip. However, this sling carrier does not provide adequate support to an infant. Specifically, the infant leans back (away from the adult) in the sling. This increases the chances that the infant may fall out of the sling backwards. Therefore, the adult must continuously hold their am around the back of the infant for additional support. In addition, since the infant is merely lying on a piece of material in a hammock-like fashion, the infant is not safely carried within the sling. The infant can easily fall out of such a sling-configured carrier. The danger to an infant is magnified with an infant able to sit up on his own and move (i.e., an infant older than six months).

Still another type of existing carrier is a front pack type carrier. With front pack type carriers, another disadvantage is the difficulty in wearing and adjusting the carrier. The adult typically must unbuckle and buckle one or more straps, which can be very difficult when tending to the needs of an infant. These carriers are very uncomfortable when carrying a baby weighing more than approximately 15 pounds. Considerable strain is placed on the back and shoulders of the adult using this type of carrier. Additionally, the infant is uncomfortably positioned within the carrier because the legs of the infant are left hanging straight down.

None of the existing infant carriers provide adequate support for an infant while enabling the infant to rest upon the carrying adult's hip. An apparatus is needed which enables an adult to comfortably and securely carry the infant upon the adult's hip. In addition, a carrier is needed which allows an adult to comfortably carry an infant weighing more than 15 pounds. Supporting an infant on the hip of the adult enables a majority of the infant's weight to be supported on the hip of the adult, rather than on the back of the adult. Additionally, a carrier is needed which enables the adult to easily adjust the positioning of the infant upon the hip of the adult.

Thus, it would be a distinct advantage to have an apparatus, which effectively and comfortably carries an infant on an adult's hip and allows ease in adjustment of the positioning of the infant within the carrier and upon the adult's hip. It is an object of the present invention to provide such an apparatus.

SUMMARY OF THE INVENTION

In one aspect, the present invention is an infant carrier for carrying an infant by an individual. The infant carrier includes a harness having a main body section with at least four corners. The main body section has two apertures and a back support for supporting the infant within the harness. In addition, the main body section has a first edge, an opposite second edge, and two sides. The carrier also includes a near shoulder strap having a first end and second end. Each end extends from the first edge of the main body section at an approximately 90 degree angle in relation to the first edge. The near shoulder strap is supported by the first shoulder of the individual. The near shoulder strap is adjustable in length to provide adjustment for properly positioning the infant in the carrier and for properly positioning the infant on the wearer's hip. The carrier also includes a far shoulder strap having a first end and a second end. Each end extends from the second edge opposite the first edge at an angle between 20 and 80 degrees in relation to the sides of the main body section. The far shoulder strap is supported by the second shoulder of the individual. The infant is supported on the hip of the individual and by the near shoulder strap upon the first shoulder and the far shoulder strap upon the second shoulder.

DESCRIPTION OF THE INVENTION

Figure 1:
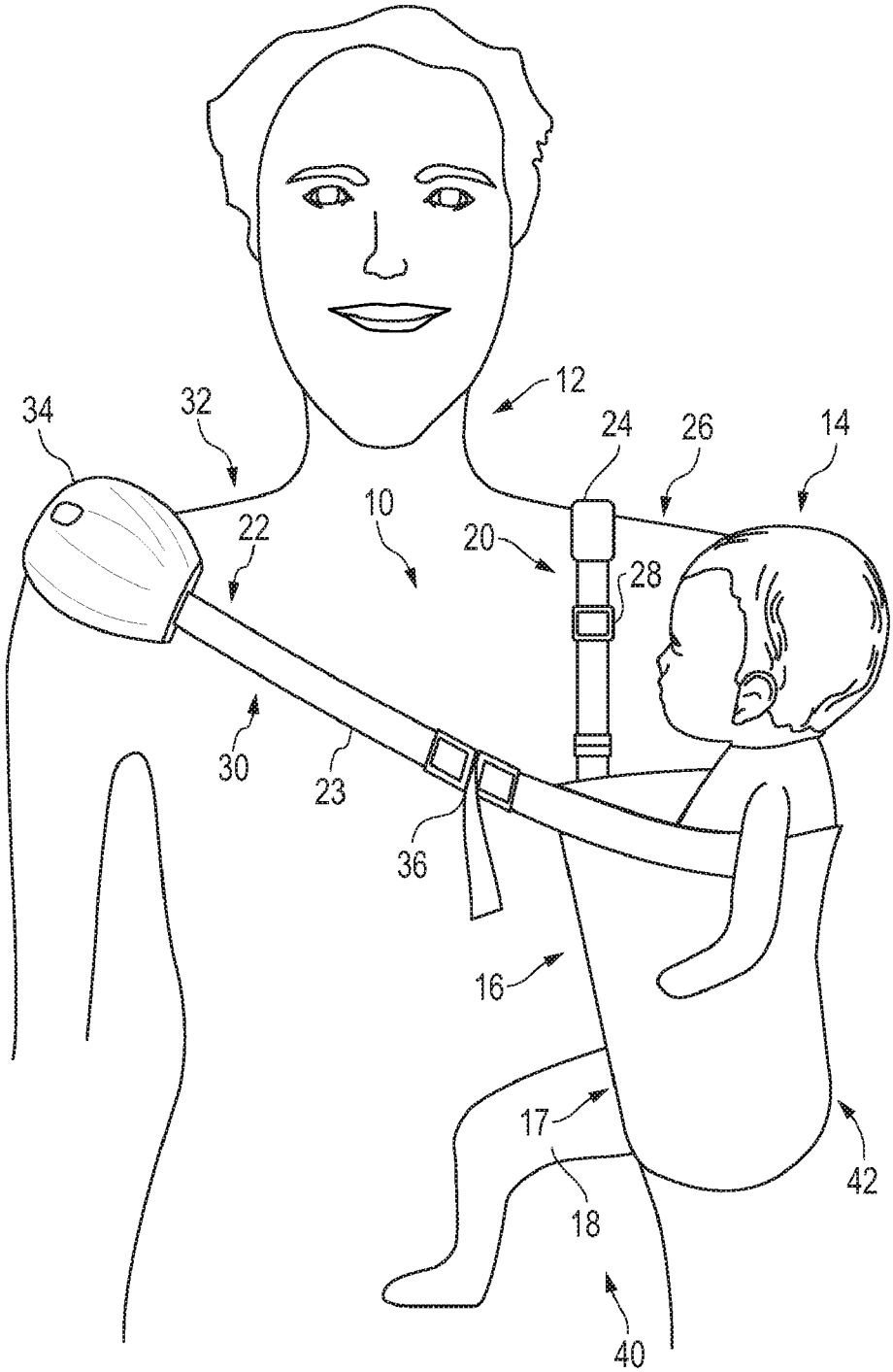
FIG. 1 is a front perspective view of an infant carrier worn by an adult in the preferred embodiment of the present invention.

The present invention is an apparatus for carrying an infant upon an adult's hip. FIG. 1 is a front perspective view of an infant carrier 10 worn by an adult 12 in the preferred embodiment of the present invention. The infant carrier 10 carries an infant 14 in a harness 16. The body harness 16 includes two leg apertures 17 (one shown in FIG. 1) through which each leg 18 of the infant passes through. The harness 16 includes a near shoulder strap 20 and an opposite far shoulder strap 22.

The near shoulder strap 20 may optionally include a padded section 24 conforming to the shoulder 26 closest to the harness 16 and infant 14. Preferably, the padded section 24 is constructed of a flexible knit material to provide comfort to the adult 12. The near shoulder strap may also be optionally adjustable in length. The adjustability of the length of the near shoulder strap 20 may be accomplished by strap adjusters 28 (FIG. 3), allowing the lengthening or shortening of the near shoulder strap 20. The near shoulder strap 20 may be configured in any fashion, which allows the near shoulder 26 to bear a portion of the weight of the infant.

The far shoulder strap 22 includes a frontal chest section 23 crossing over the front of the chest 30 and a back section 25 (FIG. 3) crossing over the back of the adult 12 to rest upon the far shoulder 32. The far shoulder strap 22 optionally includes a widened section 34 resting upon the outermost portion of the far shoulder 32. The widened section 34 enables the far shoulder strap 22 to comfortably rest upon the far shoulder 32 (cup the shoulder) of the adult 12. Alternatively, the widened section 34 may included a padded area for the comfort of the adult. The far shoulder strap 22 may be adjustable in length. The adjustment of the length of the far shoulder strap may be by any configuration, for example, by an adjustment buckle 36 commonly used for adjusting a length of a strap on a backpack. The adjustment buckle may be a part of the far shoulder strap lying across the chest of the adult and may attach to the far shoulder pad. It should be understood that the far shoulder strap 22 may be configured in any fashion allowing the far shoulder 32 to bear a portion of the weight of the infant 14.

The harness 16 is preferably constructed of a flexible material such as a heavy cotton matter. The harness 16 is configured to enable the infant to sit upright in the harness with the legs 18 protruding through the apertures 17.

Figure 2:
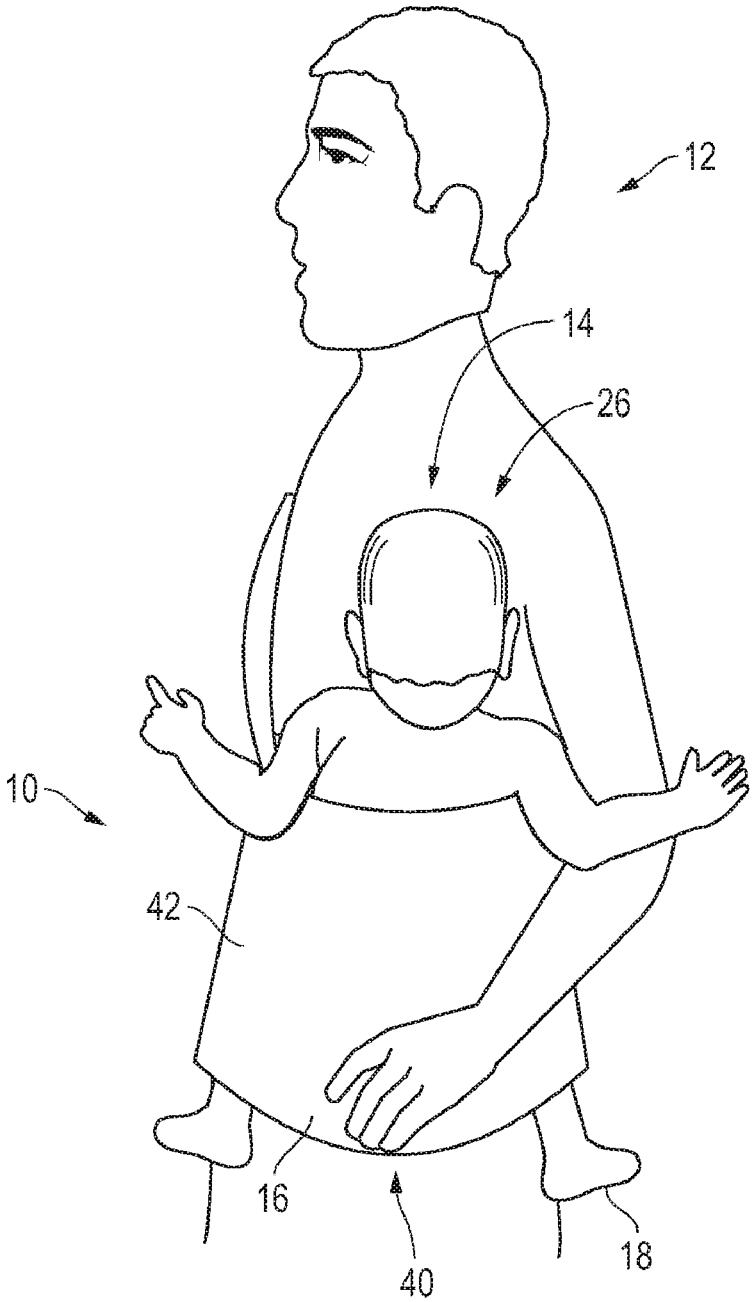
FIG. 2 is a side view of the infant carrier carrying the infant against the hip of the adult in the preferred embodiment of the present invention.

FIG. 2 is a side view of the infant carrier 10 carrying the infant 14 against the hip 40 of the adult 12 in the preferred embodiment of the present invention. The harness enables the infant to sit upright against a back portion 42 of the harness 16. The legs 18 run through the apertures 17. The legs straddle the side of the torso of the adult with the infant resting against the hip 40 of the adult. The configuration of the harness is designed so that the infant's legs assume a natural hip riding position, rather than just allowing the legs to hang straight down.

Figure 3:
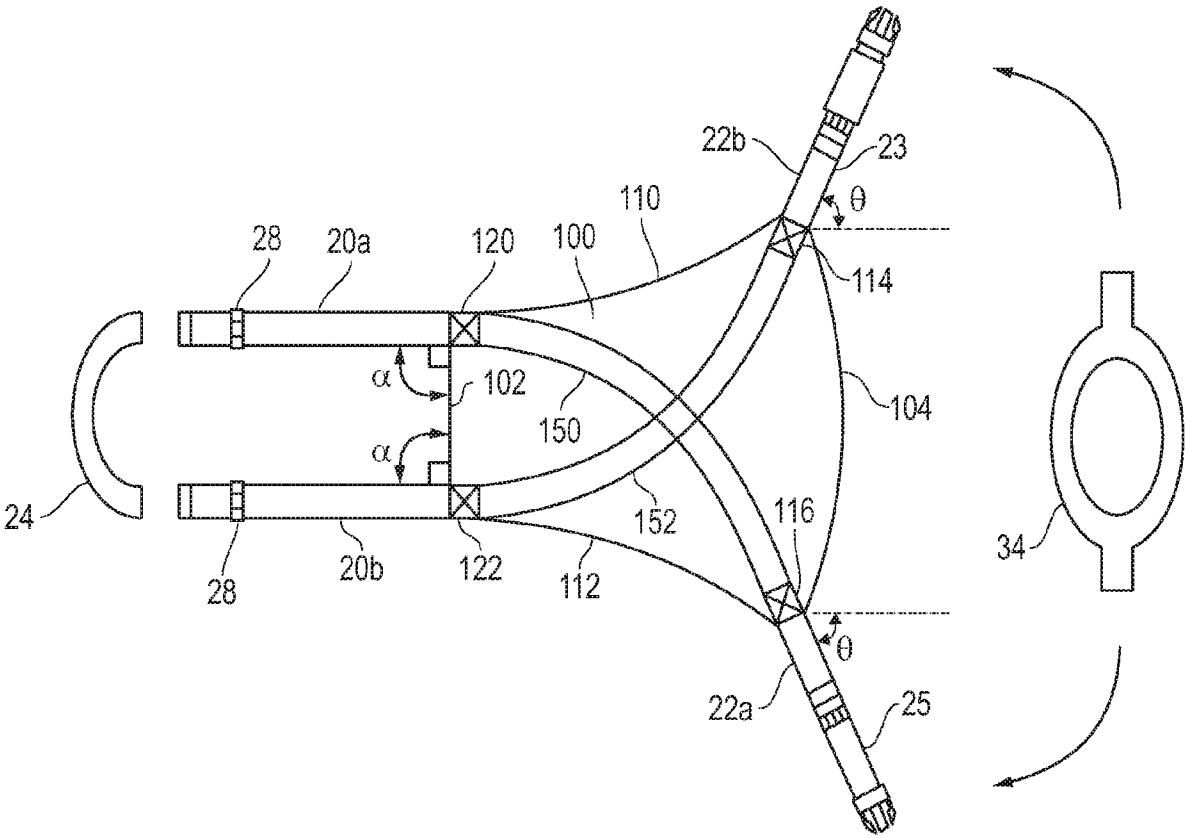
FIG. 3 is a top plan view of the infant carrier detached from the adult.

FIG. 3 is a top plan view of the infant carrier 10 detached from the adult 12. In FIG. 3, for illustrative purposes only, the near shoulder strap 20 and far shoulder strap 22 are shown detached from the padded shoulder portions. The placement of the straps upon the harness is very important for providing a comfortable carriage of the infant for both the adult and the infant. The harness includes a main body section 100 which is in a substantially trapezoidal shape. The main body section includes a first straight edge 102 and a second curved edge 104. The edges may be curved or straight in still remain in the scope of the present invention. The main body section also includes two sides 110 and 112. The sides 110 and 112 preferably curve outwardly from the straight edge 102 to corners 114 and 116 located on the curved edge 104. The far shoulder straps 22 protrude from the corners 114 and 116 at an angle $\phi$ at approximately 45 degree angle. To provide comfort for the adult and infant, the straps are angled from the corner ranging from 20 to 80 degrees (angle $\phi$) outwardly relative to the sides 110 and 112. In addition, the near shoulder straps protrude straight out at an angle $\alpha$ of approximately 90 degrees from corners 120 and 122. To facilitate proper placement of the infant upon the hip of the adult, the straps must protrude out from the main body section at the angles described above.

In the preferred embodiment of the present invention, the straps are actually two lengths of material crossed within the main body section 100. The near shoulder strap 20*a* is contiguous with far shoulder strap 22*a*. Likewise, near shoulder strap 20*b* is congruous with far shoulder strap 22*b*. The straps cross within the main body section 100 as interior straps 150 and 152. The interior straps are preferably positioned between two or more cloth sections forming the main body section. The straps are also preferably constructed of a webbing material. In an alternate embodiment of the present invention, the near and far shoulder straps are not contiguous and are attached to the corners of the main body section.

With reference to FIGS. 1-3, the operation of the infant carrier 10 will now be explained. The infant carrier is worn by the adult 12 by positioning the far shoulder strap 22 upon the far shoulder 32. Preferably, the widened section 34 rests on the outmost portion of the shoulder 32. The near shoulder strap 20 rests upon the near shoulder 26. The padded sections prevent the straps from digging into the shoulders of the individual. The infant 14 is carried within the harness 16 in a conventional manner well known in harnesses. The infant's legs preferably straddle the side of the torso of the adult 12 in a hip-riding fashion. A portion of the weight of the infant is carried upon the hip 40 of the adult. If necessary, the near and far shoulder straps may be easily adjusted either with the infant in or out of the harness 16. The infant may be carried on either hip.

The infant carrier may be configured in any fashion which utilizes two straps, one position on a portion of each shoulder of the adult carrier and allow transport of the infant upon the adult's hip. The straps may be constructed of any material allowing the safe support of the infant. The infant carrier 10, when not carrying an infant, may be folded and worn around the waist or shoulder of the individual.

The infant carrier 10 provides many advantages over existing devices. The present invention enables an adult to comfortably carry an infant upon her hip. The infant carrier 10 distributes the weight of the infant over two shoulders and the hip of the adult. In addition, the infant carrier enables the adult to easily adjust the straps while the infant is in the infant carrier. The infant is safely supported in the harness 16, which does not allow the infant to slip out of the carrier, as is a significant problem in existing infant carriers. The present invention also supports the infant in an upright sitting position, which is far more comfortable for an infant capable of sitting upright on his own. The infant carrier also enables carriage of the infant on either hip.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An infant carrier for carrying an infant by an individual, said infant carrier comprising:

a harness having a main body section, the main body section having two apertures and a back support for supporting the infant within the harness;

the main body section have a first edge, an opposite second edge, and two sides;

a near shoulder strap having a first end and second end, each end being affixed to and extending from the first edge of the main body section at an approximately 90 degree angle in relation to the first edge, said near shoulder strap supported by the first shoulder of the individual;

said near shoulder strap being adjustable in length to provide an adjustment means for properly positioning the infant in the carrier; and a far shoulder strap having a first end and a second end, each end extending from the second edge opposite the first edge at an angle between 20 and 80 degrees in relation to the sides of the main body section, said far shoulder strap supported by the second shoulder of the individual;

the infant being supported along on the hip of the individual and by said near shoulder strap upon the first shoulder and said far shoulder strap upon the second shoulder.

2. The infant carrier of claim 1 wherein said near shoulder strap includes a first adjusting means for adjusting the length of said near shoulder strap to adjust the vertical positioning of the infant in relation to the individual to provide proper placement of the infant on the hip of the individual.

3. The infant carrier of claim 2 wherein said first adjusting means is accessible by the individual while carrying the infant.

4. The infant carrier of claim 3 wherein said first adjusting means is located on a section of said near shoulder strap resting upon a chest region of the individual of said near shoulder strap adjusts the position of the infant within the harness.

5. The infant carrier of claim 4 wherein said near shoulder strap includes a padded area for placement on the first shoulder of the individual the first adjusting means includes means for adjusting the height of the harness in relation to the back of the infant.

6. The infant carrier of claim 1 wherein said far shoulder strap includes a second adjusting means for adjusting the length of said far shoulder strap.

7. The infant carrier of claim 6 wherein the second adjusting means is accessible by the individual while carrying the infant.

8. The infant carrier of claim 1 wherein said far shoulder strap includes a widened area for placement and cupping on the second shoulder of the individual.

9. The infant carrier of claim 1 wherein the infant's legs are position in the apertures and the back of the infant lies against the back support.

10. The infant carrier of claim 1 wherein said far shoulder strap includes a front section resting against the chest of the individual and a back section resting against a back section of the individual.

11. The infant carrier of claim 1 wherein the first end and second end of the far shoulder strap extends out from the second edge at an approximately 45 degree angle.

12. The infant carrier of claim 1 wherein the first end of the far shoulder strap is contiguous with the first end of the near shoulder strap and the second end of the far shoulder strap is contiguous with the second end of the near shoulder strap.

13. The infant carrier of claim 1 wherein the main body section is substantially trapezoidal in shape.

14. The infant carrier of claim 1 wherein the first edge is substantially straight and the second edge is substantially curved.

15. The infant carrier of claim 14 wherein the sides are curved outwardly from the first edge to the second edge.

* * * * *